United States Patent [19]

Boulton

[11] 4,126,534

[45] Nov. 21, 1978

[54] MONOPOLAR ELECTROLYTIC CELL ELECTRODES

[75] Inventor: Thomas W. Boulton, Runcorn, England

[73] Assignee: Imperial Chemical Industries Limited, London, England

[21] Appl. No.: 819,962

[22] Filed: Jul. 28, 1977

[30] Foreign Application Priority Data

Aug. 4, 1976 [GB] United Kingdom ..... 32489/76

[51] Int. Cl.[2] ..... C25B 9/00; C25B 11/02; C25B 11/10

[52] U.S. Cl. ..... 204/266; 204/288; 204/290 F

[58] Field of Search ..... 204/288, 289, 290 R, 204/290 F, 266, 243 R, 253–265, 252

[56] References Cited

U.S. PATENT DOCUMENTS

| | | | |
|---|---|---|---|
| 3,468,786 | 9/1969 | Day | 204/243 R |
| 3,909,378 | 9/1975 | Walmsley | 204/296 X |
| 3,944,477 | 3/1976 | Argade | 204/296 X |
| 4,017,375 | 4/1977 | Pohto | 204/255 |

FOREIGN PATENT DOCUMENTS

| | | | |
|---|---|---|---|
| 53,805 | 4/1934 | Norway | 204/252 |
| 965,958 | 8/1964 | United Kingdom | 204/290 F |

*Primary Examiner*—John H. Mack
*Assistant Examiner*—D. R. Valentine
*Attorney, Agent, or Firm*—Cushman, Darby & Cushman

[57] ABSTRACT

An electrode suitable for use in a monopolar electrolytic cell of the filter press type the electrode comprising a group of elongated metal members, e.g. wires or rods, electrically conductively mounted on and projecting from at least one surface of a metal sheet, and optionally from both surfaces thereof, so that a part of the members lies in a plane laterally spaced from and substantially parallel to the surface of the sheet, the members mounted on one surface, and optionally the members mounted on both surfaces, being flexible.

32 Claims, 5 Drawing Figures

Figure 2:
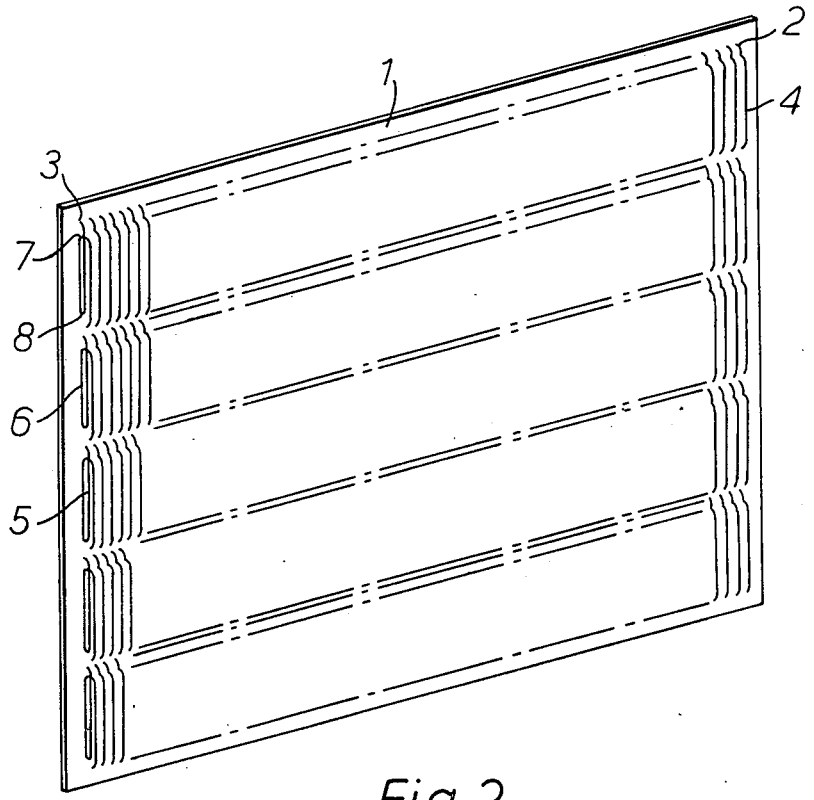

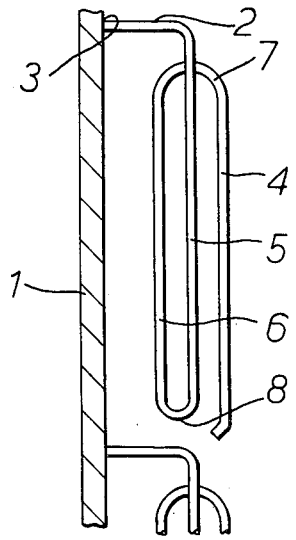
Fig. 1
Fig. 3
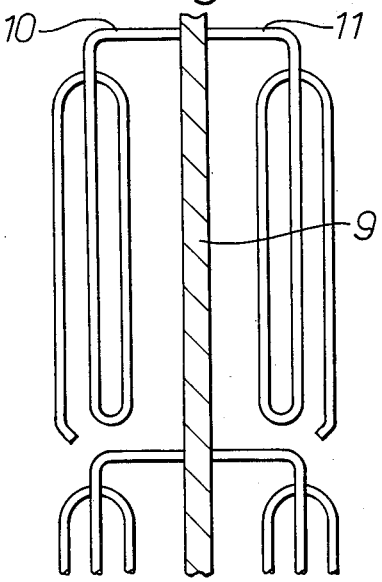
Fig. 4
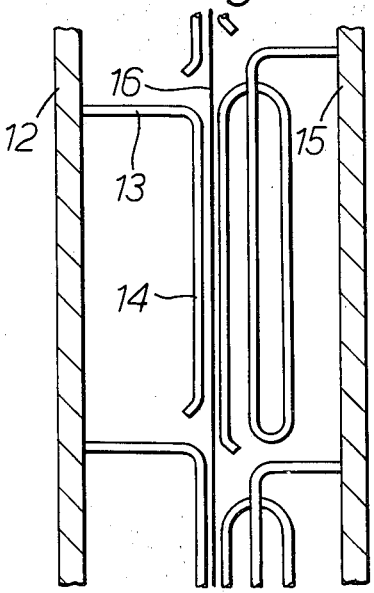

MONOPOLAR ELECTROLYTIC CELL ELECTRODES

This invention relates to an electrode and to an electrolytic cell incorporating the electrode, particularly an electrode for use in a monopolar electrolytic cell of the filter press type suitable for use in the electrolysis of aqueous solutions of alkali metal halides, especially alkali metal chlorides.

Monopolar filter press electrolytic cells are known comprising a terminal anode and a terminal cathode and a plurality of cathodes and anodes positioned alternately between the terminal anode and cathode. A separator, which may be a diaphragm or a membrane, is positioned between each adjacent anode and cathode so as to divide up the cell into a plurality of anode and cathode compartments. Each of the anode compartments is equipped with an inlet through which electrolyte may be fed to the compartment and an outlet or outlets through which liquids and gases may be removed from the compartment, and each cathode compartment is similarly equipped with an outlet or outlets and if necessary with an inlet through which liquid, e.g. water, may be fed to the cathode compartments. Each of the anodes in the cell is also equipped with connections through which electrical current may be fed to the cell and each of the cathodes is equipped with connections through which electrical current may be led away from the cell.

In a diaphragm or membrane cell of the monopolar filter press type it is advantageous to operate with as small a distance as possible between an anode and an adjacent cathode (the anode/cathode gap) in order to keep ohmic losses, and hence the cell voltage, to a minimum. Monopolar cells of recent design comprise an anode which is suitably in the form of a plate of a film-forming metal, usually titanium, the plate carrying an electrocatalytically active coating, for example a platinum group metal oxide, and a cathode which is suitably in the form of a perforated, e.g. foraminous plate of metal, usually mild steel.

The diaphragms or membranes are generally in contact with the foraminous cathode and in order to achieve a small anode-cathode gap without at the same time damaging the diaphragm or membrane it is necessary to exercise considerable care in order to manufacture anodes having a suitable degree of flatness and it is also necessary to maintain this flatness during the heat treatment involved in coating the anode with an electrocatalytically active coating. Furthermore, great care must be exercised in assembling the electrodes in an electrolytic cell if damage to the diaphragms or membranes is to be avoided.

We have now devised an electrode for use in a monopolar electrolytic cell of the filter press type which allows very small or even zero anode/cathode gaps to be used in such cells without damage to the diaphragms or membranes.

The present invention provides an electrode suitable for use in a monopolar electrolytic cell of the filter press type said electrode comprising a group of elongated metal members electrically conductively mounted on and projecting from at least one surface of a metal sheet so that a part of the members lies in a plane laterally spaced from and substantially parallel to the surface of the sheet, said members being flexible.

Where the electrode is for use as an anode in an electrolytic cell it is suitably made of a film-forming metal by which we mean one of the metals titanium, zirconium, niobium, tantalum or tungsten or an alloy consisting principally of one of these metals and having polarisation properties comparable to those of the corresponding metal. It is preferred to use titanium alone or an alloy based on titanium and having polarisation properties comparable with those of titanium. Examples of such alloys are titanium-zirconium alloys containing up to 14% of zirconium, alloys of titanium with up to 5% of a platinum group metal, e.g. platinum, rhodium or iridium, and alloys of titanium with niobium or tantalum containing up to 10% of the alloying constituent. Where the electrode is an anode it suitably also is coated with an electrocatalytically active coating.

Where the electrode is for use as a cathode in an electrolytic cell any suitable metal which is different from the film-forming metal of the anode may be used provided that it is sufficiently electrically conductive and is resistant to the electrolyte to be used in the electrolytic cell. Where the electrode is for use as a cathode in a cell for the electrolysis of aqueous alkali metal halide solutions a suitable metal is iron or steel, e.g. mild steel, although other metals, e.g. nickel may be used.

The elongated members of the electrode are preferably in the form of wires or rods. The elongated members may be made flexible by controlling their shape and dimensions, e.g. their thickness. For example, substantially straight wires or rods which are bent at one end near the point of attachment to the metal sheet of the electrode may be essentially rigid, whereas flexibility may be obtained by bending the wires or rods in two or more places, for example to form loops. Also, the less is the thickness of the wire or rod the greater will be the flexibility of the wire or rod.

A suitable thickness for the wires or rods is in the range 1 to 6 mm, preferably 2 to 4 mm, e.g. 3 mm.

Where the electrode is to be used as a terminal anode in an electrolytic cell one face only of the metal sheet will be provided with a group of elongated flexible metal members, and similarly, where the electrode is to be used as a terminal cathode in an electrolytic cell one face only of the metal sheet will be provided with a group of flexible elongated metal members.

The electrode may be suitable for use as one of the electrodes, that is either an anode or cathode or both, positioned alternately in the electrolytic cell between the terminal anode and cathode. In this case both surfaces of the metal sheet suitably carry a group of elongated metal members electrically conductively mounted on and projecting from the surface of the sheet and lying in planes substantially parallel to and laterally spaced from the surfaces of the sheet, at least one of the groups of elongated members being flexible. The groups of elongated metal members on both faces of the sheet may be flexible or if desired one group may be flexible and one may be rigid. When one of the groups of elongated metal members is rigid the members may conveniently be in the form of rigid wires or rods, although other types of rigid members may be used, especially in the case of anodes, e.g. blades or slotted members, e.g. louvred members, or expanded metal.

Where the electrodes of the invention as hereinbefore described are used in an electrolytic cell it is preferred that those electrodes which are to be used as cathodes comprise a group of flexible members on one surface of the metal sheet of the electrode, in the case of a terminal cathode, or a group of flexible members on both faces of the metal sheet of the electrode, in the case of an internal cathode. In such an electrolytic cell the elongated members on the electrode which is to be used as the anode may be rigid. Such an arrangement is preferred as, in view of the higher cost of film-forming metal, for use in the anode, relative to cathode metal, e.g. iron or steel, and the generally lower conductivity of such film forming metals it is preferred to use elongated members of film forming metal which are as short as possible and which, in view of the relative shortness, are thus in general rigid. Alternatively, the elongated members on the anode may also be flexible.

As the electrode of the invention, when forming the anode and/or cathode of an electrolytic cell, comprises a group or groups of elongated members which are flexible the electrodes may be assembled into an electrolytic cell with little or no resultant damage to the diaphragm or membrane positioned between the electrodes should the groups of elongated members come into contact with the diaphragm or membrane. If contact is made then damage to the diaphragm or membrane may be reduced or avoided as the elongated members are able to flex towards the metal sheet forming part of the electrode.

In the electrode it is preferred that a substantial part of each of the elongated members are laterally spaced from and substantially parallel to the metal sheet of the electrode. The parts of the elongated members which lie in a plane are preferably substantially parallel to each other.

The elongated members may be attached to the metal sheet in the electrode by welding, for example, by capacitor discharge welding.

Where the electrode is to be used as an anode in an electrolytic cell for the electrolysis of aqueous solutions of alkali metal halides then the electrode suitably carries an electrocatalytically active coating, that is a coating which is resistant to electrochemical attack but which is active in transferring electrons between the electrolyte and the anode electrode. At least those parts of the elongated members of the anode which are laterally spaced from the metal sheet, e.g. of film-forming metal, desirably carry an electrocatalytically active coating. If desired the whole of the elongated members and optionally the metal sheet may carry an electrocatalytically active coating.

The electrocatalytically active material may suitably consist of one or more platinum group metals, i.e. platinum, rhodium, iridium, ruthenium, osmium and palladium, and/or alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chloride discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron, cobalt, nickel and mixtures thereof. Especially suitable electrocatalytically active coatings include platinum itself and those based on ruthenium dioxide/titanium dioxide and ruthenium dioxide/tin dioxide/titanium dioxide.

Other suitable coatings include those described in our U.K. patent specification No. 1,402,414 and our U.K. patent application No. 49898/73 (Belgian Pat. No. 821,470) in which a non-conducting particulate or fibrous refractory material is embedded in a matrix of an electrocatalytically active material (of the type described above). Suitable non-conducting particulate or fibrous materials include oxides, fluorides, nitrides and sulphides. Suitable oxides, including complex oxides, include zirconia, alumina, silica, thorium oxide, titanium dioxide, ceric oxide, hafnium oxide, ditantalum pentoxide, magnesium aluminate, e.g. spinel $MgO.Al_2O_3$, aluminosilicates, e.g. mullite $(Al_2O_3)_3$ $(SiO_2)_2$, zirconium silicate, glass, calcium silicate, e.g. bellite $(CaO)_2$ $SiO_2$, calcium aluminate, calcium titanate, e.g. perovskite $CaTiO_3$, attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

Those parts of the electrodes of the invention which are to be coated with an electrocatalytically active coating may be coated using a painting and firing technique wherein a coating of metal and/or metal oxide is formed on the electrode surface, e.g. on the surface of the flexible elongated members, by applying to the surface of the members a layer of a paint composition comprising a liquid vehicle and thermally decomposable compounds of each of the metals that are to feature in the finished coating, drying the paint layer by evaporating the liquid vehicle, and then firing the paint layer by heating the coated electrode suitably at a temperature in the range 250° C. to 800° C., to decompose the metal compounds of the paint and form a coating of the desired composition. When refractory particles or fibres are to be embedded in the metal and/or metal oxide of the coating, the refractory particles or fibres may be mixed into the aforesaid paint composition before it is applied to the electrode. Alternatively, the refractory particles or fibres may be applied to a layer of the aforesaid paint composition while this is still in the fluid state on the surface of the electrode, the paint layer then being dried by evaporation of the liquid vehicle and firing in the usual manner.

The electrocatalytically active coating on the electrode is preferably built up by applying a plurality of paint layers on the electrode, each layer being dried and fired before applying the next layer.

According to a further embodiment of the invention there is provided a monopolar electrolytic cell of the filter press type comprising (a) a terminal metal anode, for example of a film forming metal, having on a surface thereof an electrocatalytically active coating, (b) a terminal metal cathode, for example of iron or steel, substantially parallel to said anode, and (c) a separator, for example a diaphragm or cation exchange membrane, positioned between said anode and said cathode thereby forming an anode and cathode compartment, the anode or the cathode, or both, comprising a metal sheet having a group of elongated metal members electrically conductively mounted on and projecting from one surface of the metal sheet so that a part of the members lies in a plane laterally spaced from and substantially parallel to the surface of the sheet, said members being flexible, and said anode compartment being provided with an inlet for electrolyte and outlets for liquids and gases and said cathode compartment being provided with outlets for liquids and gases.

The electrolytic cell may comprise an internal cathode or cathodes and an internal anode or anodes positioned alternately between and substantially parallel to the terminal anode and cathode, and a separator, e.g. a diaphragm or membrane, positioned between each adjacent anode and cathode so as to provide in the cell a plurality of anode and cathode compartments.

The anodes and cathodes may have any of the form hereinbefore described.

The separator may be a porous diaphragm or a cation exchange membrane.

Any suitable diaphragm material may be used, but it is preferred to use porous fluoropolymer, e.g. polytetrafluoroethylene, diaphragms. Suitable diaphragms may be prepared from aqueous dispersions of polytetrafluoroethylene and removable filler by the methods described in our U.K. patent specification Nos. 1,081,046 and 1,424,804. The filler may be removed prior to introducing the diaphragm into the cell, for example by treatment with acid to dissolve the filler. Alternatively the filler may be removed from the diaphragm in situ in the cell, for example as described in our U.K. patent specification No. 1,468,355 in which either acid containing a corrosion inhibitor is used to dissolve the filler or the filler is removed electrolytically.

Alternatively, the diaphragm may be formed from sheets of porous polymeric material containing units derived from tetrafluoroethylene, said material having a microstructure characterised by nodes interconnected by fibrils. The aforesaid polymeric material and its preparation are described in U.K. Pat. No. 1,355,373, and its use as a diaphragm in electrolytic cells is described in our copending U.K. patent application Nos. 23275/74 and 23316/74 (Belgian Pat. No. 829,388).

The diaphragm may also be formed by an electrostatic spinning process. Such a process is described in our copending U.K. application No. 41273/74 (Belgian Pat. No. 833,912) and involves introducing a spinning liquid comprising an organic fibre forming polymer material, for example a fluorinated polymer, e.g. polytetrafluoroethylene, into an electric field, whereby fibres are drawn from the liquid to an electrode, and collecting the fibres so produced upon the electrode in the form of a porous product or mat.

Any suitable cation exchange membrane material may be used as a membrane. Such materials are generally made of synthetic organic polymeric material onto which have been grafted cation exchange groups, for example sulphonate, carboxylate or sulphonamide groups. In particular, synthetic fluoropolymers which will withstand cell conditions for long periods of time are useful, for example the perfluorosulphonic acid membranes manufactured and sold by E. I. du Pont de Nemours and Company under the trade mark "NAFION" and which are based upon copolymers of tetrafluoroethylene and fluorinated vinyl ethers. Such membranes are described, for example in U.S. Pat. Nos. 2,636,851, 3,017,338, 3,496,077, 3,560,568, 2,967,807, 3,282,875 and U.K. Pat. No. 1,184,321.

Where the cell comprises a cation exchange membrane each cathode compartment will be provided with an inlet for liquid.

The anode/cathode gap is suitably in the range 3 mm to zero preferably 1 mm to zero. Thus, where the anode/cathode gap is zero the elongated members of both the anode and cathode, that is of the anodes and cathodes between the terminal anode and cathode and of the terminal anode and cathode are in contact with the adjacent separators.

It is an advantage of the invention when using membranes, for example "NAFION", that the membrane may be supported between elongated members of the anode and the cathode thereby preventing excessive distortion of the membrane when swelling takes place during use in an electrolytic cell.

The terminal anode and cathode and the internal anode(s) and cathode(s) comprising the cell may be held together by any convenient means, for example by means of bolts, clamps, hydraulic or pneumatic jacks.

The electrolytic cell is especially useful in the manufacture of chlorine by the electrolysis of aqueous alkali metal chloride solutions, especially sodium chloride solutions.

Figure 5:
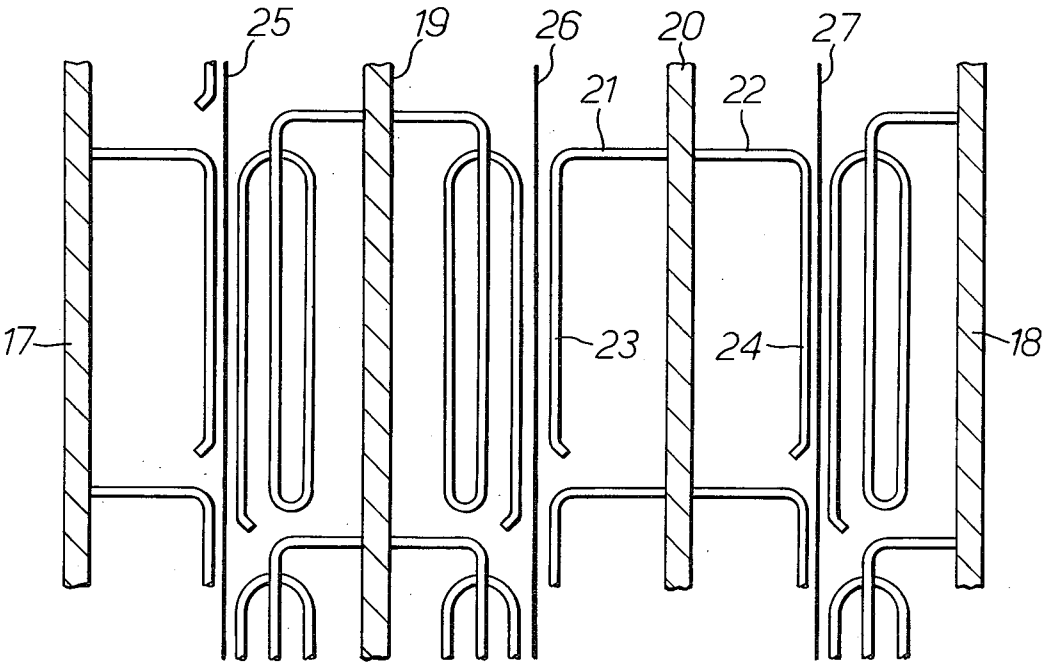

The invention is illustrated in the accompanying drawings in which:

FIG. 1 is an elevation in cross-section of a part of an electrode according to the invention, FIG. 2 is a diagrammatic view of one side only of the electrode of FIG. 1, FIG. 3 is a cross-section in elevation of a part of a modified electrode according to the invention, FIG. 4 is a cross-section in elevation of a part of a monopolar electrolytic cell containing an electrode as shown in FIG. 1, and FIG. 5 is a cross-section in elevation of a part of a monopolar electrolytic cell of the filter press type containing an electrode as shown in FIG. 1 and an electrode as shown in FIG. 3.

The electrode shown in FIG. 1, which in this embodiment is an electrode suitable for use as a terminal cathode in a momopolar electrolytic cell, comprises a sheet 1 of iron or steel and a plurality of 3 mm thick iron or steel wires 2 capacitor discharge stud welded at 3 to the sheet 1. The wires have straight portions 4, 5, 6 and have bends at 7 and 8 to form a loop which provides the wire with flexibility. The straight portions 4, 5, 6 each lie in a plane and are subtantially parallel to the face of the sheet 1 and are laterally displaced therefrom. Referring to FIG. 2 the electrode comprises a group of elongated members substantially parallel to each other and arranged in five rows.

The electrode shown in FIGS. 1 and 2 may be an anode suitable for use in a monopolar electrolytic cell in which case the sheet 1 and the wires 2 will be of a film-forming metal e.g. titanium, and at least the straight parts 4 will carry an electrocatalytically active coating.

The electrode of FIG. 3, which in this embodiment is an electrode suitable for use as a cathode positioned internally in the monopolar electrolytic cell, comprises a sheet 9 of iron or steel having on both faces thereof a plurality of iron or steel wires 10, 11 of the type described with reference to FIG. 1, the loops in the wires providing flexibility. As is the case with the electrode shown in FIG. 1, the electrode of FIG. 3 may be an anode suitable for use in a monopolar electrolytic cell in which case the sheet 9 and the wires 10, 11 will be of a film forming metal e.g. titanium, the wires carrying an electrocatalytically active coating.

FIG. 4 shows a part of a monopolar electrolytic cell having an anode in the form of a titanium sheet 12 carrying a plurality of substantially rigid 3 mm thick titanium wires 13 having straight portions 14 lying in a plane laterally displaced from and substantially parallel to the sheet 12. The wires 13 do not have a loop and are relatively rigid. The straight portions 14 carry an electrocatalytically active coating. The cell also comprises a cathode 15 of iron or steel of the type described with reference to FIG. 1.

A separator 16 is positioned between and may be in contact with the wires of the anode 12 and the wires of the cathode 15 and provides the cell with distinct anode and cathode compartments. The separator may be a porous diaphragm or a cation exchange membrane.

In FIG. 5 there is shown a monopolar electrolytic cell of the filter press type which comprises a terminal anode 17 of the same construction as the anode described with reference to FIG. 4 and a terminal cathode 18 of the same construction as the cathode described with reference to FIGS. 1 and 2. Between the terminal anode and cathode there are positioned a cathode 19 of the same construction as the cathode described with reference to FIG. 3 and an anode comprising a sheet of titanium 20 having on both faces thereof a plurality of substantially rigid 3 mm thick titanium wires 21, 22 having straight portions 23, 24 lying in planes laterally displaced from the sheet 20 and substantially parallel thereto and which carry an electrocatalytically active coating.

Separators 25, 26, 27 are positioned between the wires of adjacent anodes and cathodes thereby dividing up the cell into distinct anode and cathode compartments. Although not shown in FIG. 5 the anode compartments will in use be connected and provided with inlets for electrolyte and outlets for liquids and gases and the cathode compartments will be connected and provided with outlets for liquids and gases and optionally inlets for liquids. Furthermore each anode will be provided with a connection (not shown) leading to a source of electrical current, and each cathode will be provided with a connection (not shown) for leading electrical current away from the cell.

The separator may be a porous diaphragm or a cation exchange membrane.

The invention is further illustrated by the following Example.

A laboratory membrane cell as shown in part of FIG. 4 was assembled, the anode comprising a titanium sheet of dimensions 300 mm × 970.5 mm and having on one face thereof six rows of titanium wires, each row containing 32 wires and each wire having a straight portion 154 mm long by 3 mm diameter. The wires were provided with an electrocatalytically active coating.

The cathode comprised a mild steel sheet having five rows of flexible looped mild steel wires of 3 mm diameter each row containing 32 wires. The loops provided flexibility to the wires. The distances between the titanium sheet 12 and the membrane 16, i.e. the width of the anode compartment, and between the mild steel sheet 15 and the membrane 16, in the width of the cathode compartment, were each 28 mm.

The membrane 16 was a perfluorosulphonic acid membrane based on copolymers of tetrafluoroethylene and fluorinated vinyl ethers "NAFION" ("NAFION" is a Registered Trademark of du Pont). The membrane was adjacent to both the cathode and anode, i.e. the anode/cathode gap was zero.

Sodium chloride brine (concentration 300 grams/liter of NaCl) was fed to the anode compartment at a rate of 6 liters/hour. De-ionised water was added to the cathode compartment. The temperature of the cell was maintained at 85° C.

A current of 300 amp (equivalent to a current density of 1.8 $kA/m^2$) was passed through the cell. The cell operating voltage was 2.9 volts. The chlorine produced contained 94% by weight of $Cl_2$ and less than 0.1% by weight of $H_2$. The sodium hydroxide produced contained 10% by weight of caustic soda. The cell operated at a sodium hydroxide current efficiency of 86%.

The membrane was undamaged by the wires of the anode and cathode.

What we claim is:

1. An electrode suitable for use in a monopolar electrolytic cell of the filter press type said electrode comprising a group of elongated metal members electrically conductively and mechanically independently mounted on and projecting from at least one surface of a metal sheet so that a portion of each of the members lies in a plane laterally spaced from and substantially parallel to the surface of the sheet, said members being flexible, and said group comprising a plurality of rows and a plurality of columns of said members.

2. An electrode as claimed in claim 1 suitable for use as an anode and which is made of a film forming metal.

3. An electrode as claimed in claim 2 in which the metal is titanium.

4. An electrode as claimed in claim 2 which is coated with an electrocatalytically active coating.

5. An electrode as claimed in claim 1 suitable for use as a cathode and which is made of iron or steel.

6. An electrode as claimed in claim 1 in which the elongated members are in the form of wires or rods.

7. An electrode as claimed in claim 6 in which the wires or rods are in the form of loops.

8. An electrode as claimed in claim 6 in which the wires or rods have a thickness in the range of 1 to 6 mm.

9. An electrode as claimed in claim 8 in which the wires or rods have a thickness in the range 2 to 4 mm.

10. An electrode as claimed in claim 1 which is suitable for use as a terminal anode in a monopolar electrolytic cell of the filter press type and which is provided with a group of elongated flexible metal members on one face of the metal sheet.

11. An electrode as claimed in claim 1 which is suitable for use as a terminal cathode in a monopolar electrolytic cell of the filter press type and which is provided with a group of flexible elongated metal members on one face of the metal sheet.

12. An electrode as claimed in claim 1 in which both surfaces of the metal sheet are provided with a group of elongated metal members electrically conductively and mechanically independently mounted on and projecting from the surfaces of the sheet and lying in planes substantially parallel to and laterally spaced from the surfaces of the sheet, at least one of the groups of elongated members being flexible.

13. An electrode as claimed in claim 12 in which one group of elongated members is rigid and one group of elongated members is flexible.

14. An electrode as claimed in claim 12 in which both groups of elongated members are flexible.

15. An electrode as claimed in claim 14 which is suitable for use as a cathode in a monopolar electrolytic cell of the filter press type.

16. An electrode as claimed in claim 1 in which those parts of the elongated members which lie in a plane are substantially parallel to each other.

17. An electrode as claimed in claim 1 in which the electrodes are mounted on the sheet by capacitor discharge welding.

18. A monopolar electrolytic cell of the filter press type comprising (a) a terminal metal anode, (b) a terminal metal cathode substantially parallel to said anode, (c) a separator positioned between said anode and said cathode thereby forming an anode and cathode compartment, at least one of the anode and cathode comprising a metal sheet having a group of elongated metal members electrically conductively and mechanically independently mounted on and projecting from one surface of the metal sheet so that a portion of each of the members lies in a plane laterally spaced from and substantially parallel to the surface of the sheet, said members being flexible, and said group comprising a plurality of rows and a plurality of columns of said members, and (d) said anode compartment being provided with an inlet for electrolyte and outlets of liquids and gases and said cathode compartment being provided with outlets for liquids and gases.

19. An electrolytic cell as claimed in claim 18 which comprises at least one internal cathode and at least one internal anode positioned alternately between and substantially parallel to the terminal anode and cathode, and a separator positioned between each adjacent anode and cathode so as to provide in the cell a plurality of anode and cathode compartments.

20. An electrolytic cell as claimed in claim 19 in which at least one of the at least one internal anode and at least one internal cathode comprises a metal sheet having a group of elongated metal members electrically conductively and mechanically independently mounted on and projecting from at least one surface of the metal sheet so that a portion of each of the members lies in a plane laterally spaced from and substantially parallel to the surface of the sheet, said members being flexible and said group comprising a plurality of rows and a plurality of columns of said members.

21. An electrolytic cell as claimed in claim 20 in which the at least one internal cathode comprises a metal sheet having elongated metal members projecting from both surfaces of said sheet.

22. An electrolytic cell as claimed in claim 18 in which the separator is a prorous diaphragm.

23. An electrolytic cell as claimed in claim 22 in which the porous diaphragm is a fluoropolymer.

24. An electrolytic cell as claimed in claim 23 in which the fluoropolymer is polytetrafluoroethylene.

25. An electrolytic cell as claimed in claim 18 in which the separator is a cation exchange membrane.

26. An electrolytic cell as claimed in claim 25 in which the cation exchange membrane is a perfluorosulphonic acid based on a copolymer of tetrafluoroethylene and a fluorinated vinyl ether.

27. An electrolytic cell as claimed in claim 18 in which the anode/cathode gap is in the range 3 mm to zero.

28. An electrolytic cell as claimed in claim 18 in which the elongated members are in the form of wires or rods.

29. An electrolytic cell as claimed in claim 28 in which the elongated members are in the form of loops.

30. An electrolytic cell as claimed in claim 28 in which the wires or rods have a thickness in the range 1 to 6 mm.

31. An electrolytic cell as claimed in claim 28 in which the wires or rods have a thickness in the range 2 to 4 mm.

32. An electrolytic cell as claimed in claim 18 in which the elongated members which lie in a plane are substantially parallel to each other.

* * * * *